US008997671B2

(12) United States Patent
Holder

(10) Patent No.: US 8,997,671 B2
(45) Date of Patent: Apr. 7, 2015

(54) FREE MOTION SEWING DISK SET

(76) Inventor: Ellen Holder, Woodinville, WA (US)

( * ) Notice: Subject to any disclaimer, the term of this patent is extended or adjusted under 35 U.S.C. 154(b) by 172 days.

(21) Appl. No.: 13/603,325

(22) Filed: Sep. 4, 2012

(65) Prior Publication Data

US 2013/0055938 A1 Mar. 7, 2013

Related U.S. Application Data

(60) Provisional application No. 61/530,200, filed on Sep. 1, 2011.

(51) Int. Cl.

| | |
|---|---|
| ***D05B 35/00*** | (2006.01) |
| ***D05B 91/04*** | (2006.01) |
| *D05B 29/00* | (2006.01) |

(52) U.S. Cl.

CPC ..... *D05B 35/00* (2013.01); *D05B 91/04* (2013.01)

(58) Field of Classification Search

USPC ..... 112/117, 118, 303, 320, 260, 475.01, 112/475.03, 475.07, 136, 148, 150; 223/101

See application file for complete search history.

(56) References Cited

U.S. PATENT DOCUMENTS

| | | | | |
|---|---|---|---|---|
| 1,905,907 | A * | 4/1933 | Karle | 112/121 |
| 4,037,640 | A * | 7/1977 | Hubbard | 160/398 |
| 4,736,535 | A * | 4/1988 | Rucker | 38/102.3 |
| 5,238,237 | A * | 8/1993 | Morris et al. | 271/84 |
| 5,261,846 | A * | 11/1993 | Hanna | 446/46 |
| 5,546,877 | A * | 8/1996 | Moore | 112/103 |
| 6,390,001 | B1 * | 5/2002 | Jones | 112/470.15 |
| 6,843,190 | B1 * | 1/2005 | LaPierre-McAfee | 112/475.01 |
| 2012/0272882 | A1 * | 11/2012 | Purdy | 112/118 |

* cited by examiner

*Primary Examiner* — Ismael Izaguirre

(74) *Attorney, Agent, or Firm* — Dean A. Craine

(57) ABSTRACT

A set of sewing disks for controlling the movement of a piece of fabric over the free arm and under the needle of a sewing or quilting machine. Each disk is flat and has an oval or circular configuration and comprises three registered, stacked adhesively attached layers—a first contact layer made of open cell foam, a semi-rigid intermediate stiffener member, and a second contact layer made of closed cell foam. When each disk is placed over a piece of fabric with the lower contact layer is placed adjacent thereto, the individual's fingers are exposed at all times and placed over the opposite contact layer. The intermediate stiffener layer spreads and evenly dissipates the forces exerted by the fingers to the top contact layer to the lower contact layer. Because the finger tips are not in contact with the fabric, soiling of the fabric by the finger tips is prevented.

10 Claims, 1 Drawing Sheet

FREE MOTION SEWING DISK SET

This utility patent application is based on and claims the filing date benefit of U.S. provisional patent application (Application No. 61/530,200) filed on Sep. 1, 2011.

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to sewing accessories and more particularly to sewing accessories for helping an individual control the direction and speed of the fabric under the needle used in a sewing machine when free motion quilting.

2. Description of the Related Art

Free motion quilting (hereinafter referred to generally as 'sewing') requires an individual to manually move a single sheet of fabric, layers of fabric or multiple layers of fabric with batting in different directions over a stationary free arm and under the presser foot and needle on a sewing or quilting machine. The piece of fabric or material may be either large, bulky, small or thin. In either case, the user must hold the single fabric layer or multiple fabric layers tightly over the free arm and simultaneously move the layer or layers in the desired direction. The fabric must be held tightly and the fabric's movement must be smooth and at a constant rate so that the length of each stitch is approximately the same.

When free motion quilting, both hands are used to hold down the fabric layer or layers on the free arm on opposite sides of the presser foot and needle. Both hands are also simultaneously push and pull the piece of the fabric layer or layers over the free arm and under the presser arm in a coordinated manner so that the fabric layer or layers do not bunch up or stretch. When free motion quilting, the individual's fingers on both hands must be constantly repositioned over the fabric to push, pull and rotate the fabric but also allow the individual to see the presser arm and the needle. With some sewing projects, pins are used to temporarily attach multiple fabric layers together, which require that the machine be stopped to remove the pins and restarted. When restarting, the individual needs to reposition his or her fingers at substantially the same location and apply the same pushing or pulling force on the fabric before stopping.

Because fabric used with a sewing machine is soft and has a smooth texture, the individual's fingers slide over the fabric. To improve gripping of the fabric when sewing, some individuals wear a pair of rubber, latex gloves or garden gloves. Unfortunately, not all fabrics used with a sewing machine have the same texture or the same co-efficiency of friction so a single pair of gloves that may not be used with all fabrics. Also, because the individual is gripping other objects, such as a needle or the end of a thread) that require exposed finger tips, the gloves must be repeated removed from the individual's hands.

What is needed is a sewing accessory that helps an individual sufficiently move a piece of fabric made of different materials over the free arm and under the needle on a sewing machine when free motion sewing, and keeps the finger tips exposed.

SUMMARY OF THE INVENTION

At the heart of the invention is the discovery that flat disks with two different fabric gripping surfaces may be used in place of a pair of gloves that enable pieces of fabric made of different materials to be more easily controlled when free motion sewing.

The invention is a set of two flat disks designed to be positioned over the top surface of a piece of fabric upon which an individual places his or her fingers to impart pushing, pulling, and rotational forces on the piece of fabric to move the piece of fabric in a 360 degree arc over the free arm on a sewing machine.

In the first embodiment, the set includes at least one large disk and at least one smaller disk. Each disk is made up of three stacked layers—a first contact layer, an intermediate stiffener layer, and a second contact layer. The first contact layer is made of open cell EVA foam, the intermediate stiffener layer is made of expanded PVC plastic, and the second contact layer is made of soft, closed cell foam. In the embodiment shown herein, each disk is oval shaped but should be understood that the two disks are not limited to an oval shape and may be circular, square or irregular shape and may be same size.

During use, a piece of single or multiple layers of fabric is selected and placed over the free arm and under the presser foot and the needle on a sewing machine. Each piece of fabric may have different frictional co-efficiencies that the user may want to try different first and second contact layers against the fabric to determine which contact layer provides the greatest control of the fabric. Once the contact layer is chosen, one disk is then positioned in each hand so that the chosen contact surface is placed against and over the fabric on one side of the presser arm and needle. The user then places his or her finger tips over the opposite contact surface facing upward and exerts a pushing, pulling or rotational force on the disk.

DESCRIPTION OF THE PREFERRED EMBODIMENT(S)

Figure 1:
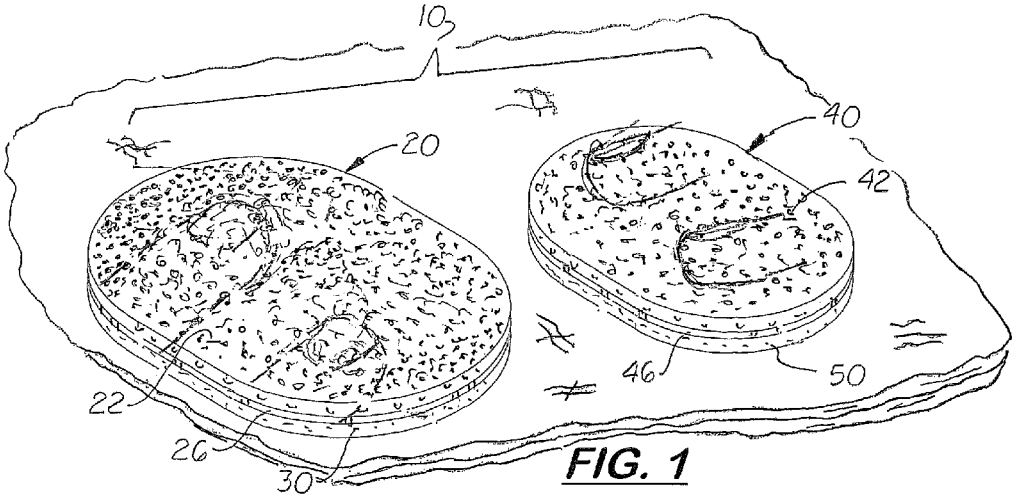
FIG. 1 is a front perspective view of the set of sewing disks shown over a quilt with the individual's fingers positioned over the disks.
Figure 2:
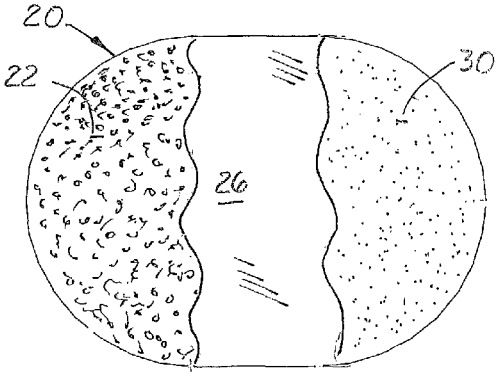
FIG. 2 is a top plan view of the large sewing disk.
Figure 3:
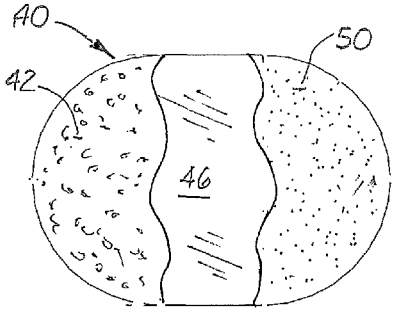
FIG. 3 is a top plan view of the small sewing disk.
Figure 4:
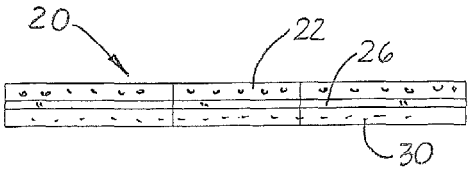
FIG. 4 is a side elevation view of the large sewing disk.
Figure 5:
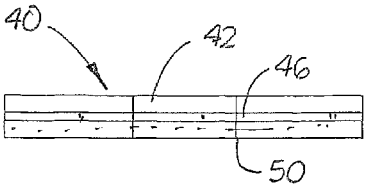
FIG. 5 is a side elevation view of the small sewing disk.

Referring to the accompanying FIGS. 1-5, there is shown a disk set 10 for free motion sewing that includes two, reversible, flat disks 20, 40 each comprising three registered and stacked layers—a first contact layer 22, 42, respectively, made of open cell EVA foam, an intermediate stiffening layer 26, 46, respectively, made of semi-rigid material such as expanded PVC plastic, and a second contact layer 30, 50, respectively, made of soft, closed cell foam such as ethylene copolymer foam. The three layers 22, 26, 30 and 42, 46, 50 in each disk 20 and 40, respectively, are adhesively attached together to form two disks approximately 1.2 cm thick. The first and second layers 20, 30 and 42, 50 on each disk 20, 40 respectively, are designed to have different gripping characteristics on different fabrics.

The two foam layers have different gripping and sliding characteristics over different fabrics. In some instances, greater gripping action is needed on one disk and less gripping action is needed on the other disc. In some instances, the same gripping action is needed for both discs. In some instances, greater sliding action over the fabric surface is needed.

In the embodiment shown herein, the disk set is made up of one large disk 20 and one small disk 40. Both disks 20 and 40 are oval shape. Oval shape disks are desireable because it allows the user to adjust the amount of contact layer longitudinally aligned and the amount of fabric in contact with the lower contact layer by rotating the disc in each hand. Providing disks 20 and 40 that are different sizes, allows the individual to use different size disks on opposites sides of the needle when sewing with different types and sizes of fabrics. It should be understood that the individual is not limited to only two disks 20 and 40, the sizes of the discs are not limited to an oval shape, and that the relatives sizes of the discs in the set are not limited, they may be same size and that they may be circular, square, rectangular, triangular, or oblong.

The overall size and thickness of the disc is important because they must allow the user to view the area of the fabric under the need at all times and a large portion of the fabric downstream of the needle. For illustration purposes, the large disk 20 shown in the Figs measures approximately 12.7 cm in length and 9.3 cm in width. The small disk 40 is also an oval and measures approximately 9.8 cm in length and 7.0 cm in width. In the second embodiment shown herein, the first and third contact layers 22, 42 and 30, 50 respectively, are 3 to 10 mm thick. The intermediate stiffener layers 26, 46 are 2 to 5 mm thick.

During use, a piece of fabric 90 is selected and placed over the free arm 92 and under the sewing or quilting machine's needle. Since each piece of fabric may have different frictional co-efficiencies, the individual must select the contact layer to be applied against the fabric 90 that provides the desired control. The two disks 20, 40 are then placed over the fabric 90 on opposite sides of the needle 94. The desired contact layer 22, 30 or 42, 50 on each disk 20, 40, respectively, is positioned directly over the top surface of the fabric 90. The individual then places his or her finger tips over the upward facing contact layer to exert a pushing, pulling or rotational force against the fabric 90 and without physically contacting the fabric 90. The intermediate stiffener layer 26, 46 is important because it acts as a substrate gluing surface for the two adjacent contact layers 22, 30 or 42, 50, respectively. During use, the intermediate stiffener layer also as a force distribution structure that dissipates the downward forces exerted by the individual fingers over the upper contact layer to the lower contact layer.

Using the above set of discs, a method of free style sewing by moving fabric across the free arm and under the needle of a sewing machine is provided comprising the following steps:

a. selecting a pair of sewing disks, each disk includes a flat, planar first contact layer made of open cell foam, a flat, planar intermediate stiffener layer, and a flat, planar second contact layer made of closed cell foam;

b. positioning a section of fabric across the free arm and under the needle of a sewing machine;

c. postioning one sewing disk on the fabric on opposite sides of the free arm;

d. activating the sewing machine; and, e. positioning the individuals hands over the disks and applying force to said discs to move the fabric over the free arm and under the needle.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A set of reversible sewing disk made up of at least two flat disks, each disk comprising at least three stacked layers, comprising:

a. a flat, planar first contact layer made of open cell foam;

b. a flat, planar intermediate stiffener layer attached to said first contact layer;

c. a flat, planar second contact layer made of closed cell foam attached to said intermediate stiffener layer opposite said first contact layer; and d. wherein said first contact layer and said second contact layer have different frictional co-efficiencies when placed against a fabric.

2. The set of sewing disks, as recited in claim 1, wherein said intermediate stiffener layer is adhesively attached in between said first contact layer and said second contact layer.

3. The set of sewing disks, as recited in claim 2, wherein said intermediate stiffener layer is made of PVC.

4. The set of sewing disks, as recited in claim 1, wherein said intermediate stiffener layer is made of PVC.

5. The set of sewing disks, as recited in claim 1, wherein each said disk is oval in shape.

6. The set of sewing disks, as recited in claim 5, wherein one said disk is larger than the other said disk.

7. The set of sewing disks, as recited in claim 6, wherein the larger said disk measures approximately 12.7 cm in length and 9.3 cm in width and the other said disk measures approximately 9.8 cm in length and 7.0 cm in width.

8. The set of sewing disks, as recited in claim 7, wherein said first and second contact layers in each said disk is 3 to 10 mm thick.

9. The set of sewing disks, as recited in claim 7, where said intermediate stiffener layer in each said disk is 2 to 5 mm thick.

10. A method of moving fabric across the free aim and under the needle of a sewing machine, comprising the following steps:

a. selecting a pair of reversible sewing disks, each said disk includes a flat, planar first contact layer made of open cell foam, a flat, planar intermediate stiffener layer attached to said first contact layer, and a flat, planer second contact layer made of closed cell foam attached to said intermediate layer opposite said first contact layer, said first contact layer and said second contact layer have different frictional co-efficiencies when placed against a fabric;

b. positioning a section of fabric across the free arm and under the needle of a sewing machine;

c. determining which said first or second contact layer should be placed over the fabric provides the greatest control of the fabric over the free arm and under the needle;

d. positioning one sewing disk on the fabric on opposite sides of the free arm;

e. activating the sewing machine; and f. positioning the individual's fingers on one hand over one said disk and using the fingers to apply force to said disks to move the fabric over the free arm and under the needle.

* * * * *